US007959463B1

(12) United States Patent
Menze et al.

(10) Patent No.: US 7,959,463 B1
(45) Date of Patent: Jun. 14, 2011

(54) HEATED CONNECTOR FOR SNOW PLOW LIGHTING SYSTEM

(75) Inventors: William F. Menze, Escanaba, MI (US); Michael L. Schultz, Lomira, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 12/781,345

(22) Filed: May 17, 2010

(51) Int. Cl.
*H01R 33/945* (2006.01)

(52) U.S. Cl. ..... 439/577

(58) Field of Classification Search ..... 439/271, 439/577, 193, 34; 219/209, 210
See application file for complete search history.

(56) References Cited

U.S. PATENT DOCUMENTS 3,584,189 A * 6/1971 Marcoux ..... 219/209
6,102,736 A * 8/2000 Leeb ..... 439/577

* cited by examiner

*Primary Examiner* — Javaid Nasri
(74) *Attorney, Agent, or Firm* — Reinhart Boerner Van Deuren s.c.

(57) ABSTRACT

A pair of mating electrical connectors are disclosed that include at least one heat generating element to prevent the electrical connectors from becoming covered with ice or snow in cold climates and to also make the electrical connectors easier to separate or plug together in cold environments. When the mating electrical connectors are connected and energized, electricity will flow through the at least one electrical heat generating element generating heat within the electrical connectors. The amount of heat that is generated within the electrical connectors is sufficient to prevent snow and ice from forming on the exterior of the mating electrical connectors, even in very cold ambient weather conditions, and to ease the disconnection of the mated electrical connectors in such cold ambient weather conditions.

23 Claims, 5 Drawing Sheets

HEATED CONNECTOR FOR SNOW PLOW LIGHTING SYSTEM

BACKGROUND OF THE INVENTION

Field of the Invention

The present invention relates generally to electrical connectors, and more specifically to mating electrical connectors that include at least one heat generating element to prevent the electrical connectors from becoming covered with ice or snow in cold climates and to also make the electrical connectors easier to separate or plug together in cold environments.

Snow plows, spreaders, and other cold weather vehicle accessories have been mounted on vehicles such as pickup trucks or sport utility vehicles (SUV's) for some time. Such snow plows, spreaders, and other cold weather vehicle accessories are removable from the vehicle so that they need be attached to the vehicle only when needed. Typically, the installation and removal of such cold weather vehicle accessories has two aspects, namely a mechanical attachment aspect and an electrical connection aspect. The mechanical attachment aspect involves the mechanical apparatus used to conveniently and removably mount such cold weather vehicle accessories onto a vehicle.

The electrical connection aspect involves supplying electrical power as well as electrical control signals from the vehicle to the cold weather vehicle accessory. For example, for snow plows, electrical connections between the vehicle and the snow plow include a power connection, multiple electrical connections to operate the plow mechanism to raise, lower, and angle a snow plow blade, and multiple connections to operate headlights, running lights, and turn signals mounted on the snow plow. For spreaders, electrical connections between the vehicle and the spreader include a power connection multiple electrical connections to operate the spreader.

Since such cold weather vehicle accessories must be easy and convenient to install onto and remove from a vehicle, those skilled in the art will understand that the electrical connections between a vehicle and the cold weather vehicle accessory must necessarily be made using one or more mating pair of electrical connectors that may be conveniently engaged and disengaged to respectively connect and disconnect a cold weather vehicle accessory onto a vehicle. Such mating pairs of electrical connectors typically have engageable male and female connectors each having a multiplicity of electrical connections. Due to the application for use in which the connectors are exposed to harsh winter weather, such electrical connectors must be sealingly engageable and must also contain an locking mechanism maintaining the male and female connectors securely together until they are to be disengaged.

Such connectors typically have engageable housings with mating shrouds to seal the mating electrical contacts contained in the connectors from the harsh winter weather. While it is generally quite simple to connect the male and female electrical connectors together, it is often substantially more difficult to disconnect them while the vehicle is located in a cold outside environment. Often, snow and ice will build up on the mated connectors, which may need to be chipped off in order to access the locking mechanism on the connectors. Additionally, since the mated connectors are located in a very cold ambient environment, they often prove to be quite difficult to disconnect, since the extreme cold tends to make them difficult to pull apart even when they are no longer locked together.

Thus, it is apparent that it would be desirable to improve the characteristics such electrical connectors exhibit in cold ambient weather conditions by heating the electrical connectors. In this regard, it would be desirable that such heated electrical connectors exhibit the capability of inhibiting the buildup of snow and ice on the exterior surface of the electrical connectors. Further, it would be desirable that such heated electrical connectors are substantially easier to disconnect from each other even in very cold ambient weather conditions.

The heated electrical connector of the present invention should also be of a construction which is both durable and long lasting, and it should also require little or no maintenance to be provided by the user throughout its operating lifetime. In order to enhance the market appeal of the heated electrical connector of the present invention, it should also be of inexpensive construction to thereby afford it the broadest possible market. Finally, it is also desirable that all of the aforesaid advantages and objectives of the heated electrical connector of the present invention be achieved without incurring any substantial relative disadvantage.

SUMMARY OF THE INVENTION

The disadvantages and limitations of the background art discussed above are overcome by the present invention. With this invention, a pair of mating electrical connectors are provided with an electrical heat generating element that is contained within one or both of the electrical connectors. When the mating electrical connectors are connected and the vehicle to which one of the electrical connectors is connected is being operated, electricity will flow through the electrical heat generating element(s) generating heat within the electrical connector(s).

The electrical heat generating element(s) is (are) selected so as to generate an amount of heat that is sufficient to prevent snow and ice from forming on the exterior of the mating electrical connectors, even in very cold ambient weather conditions. Additionally, the amount of heat that is generated within the electrical connector(s) is sufficient to ease the disconnection of the mated electrical connectors, even in such cold ambient weather conditions. The electrical heat generating element(s) is (are) also selected so than it (they) do not draw an excessive amount of electrical current or electrical power when they are being operated.

Optionally, more than one electrical heat generating element may be used in an electrical connector. If multiple electrical heat generating elements are used in an electrical connector, they may be optionally be connected in parallel so that only a single one of the electrical connections to the electrical connector is required. In a preferred embodiment, the electrical heat generating element may be a resistor installed within the electrical connector. Optionally, more than one resistor may be installed within the electrical connector.

The electrical heat generating element(s) in the electrical connector(s) is (are) electrically connected so that whenever the mating electrical connectors are connected together, and the vehicle to which one of the electrical connectors is connected is operating, the electrical heat generating element(s) is (are) being electrically energized. Thus, the mated electrical connectors will not be heated when the vehicle to which one of the electrical connectors is connected is not being operated, thereby preventing the battery in the vehicle from becoming discharged by the heated electrical connector. Additionally, if the electrical connectors are not connected together, neither the electrical connector that is connected to the vehicle nor its mater is either drawing electrical power or being heated.

It may therefore be seen that the present invention improves the characteristics electrical connectors exhibit in cold ambient weather conditions by heating the electrical connectors. Such heated electrical connectors exhibit the capability of inhibiting the buildup of snow and ice on the exterior surface of the electrical connectors. Further, such heated electrical connectors are substantially easier to disconnect from each other even in very cold ambient weather conditions.

The heated electrical connector of the present invention is of a construction which is both durable and long lasting, and which will require little or no maintenance to be provided by the user throughout its operating lifetime. The heated electrical connector of the present invention is also of inexpensive construction to enhance its market appeal and to thereby afford it the broadest possible market. Finally, all of the aforesaid advantages and objectives of the heated electrical connector of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the present invention involves the placement of one or more resistors into one or both of a mating pair of connectors that will be used in a cold ambient environment. When the mating pair of connectors are installed into an energized electrical circuit (which, in a vehicle, will typically require that the ignition switch is turned on) and when the pair of connectors are mated together, electricity will flow through the resistor(s) in the connector(s). The resistor(s) are appropriately sized so that the electrical power that is dissipated in it (them) will generate sufficient heat to prevent the formation of ice or the accumulation of snow on the exterior surfaces of the mated pair of connectors.

There are several different embodiments of the heated electrical connector of the present invention that are presently contemplated. A number of these embodiments are shown in exemplary form FIGS. 1 through 6, with various embodiments and features being shown in these figures. It will be appreciated by those skilled in the art that the features shown in these examples could be combined together in various combinations even though not all such combinations are shown herein for purposes of relative brevity of this specification.

For purposes of the examplary embodiments discussed herein with reference to FIGS. 1 through 6, the implementation will be assumed to be as electrical connectors used to connect the electrical system of a snow plow to the electrical system of a vehicle such as a truck on which the snow plow is mounted. It will, however, be appreciated by those skilled in the art that the heated electrical connector of the present invention could be used in any other application in a cold ambient environment.

Figure 1:
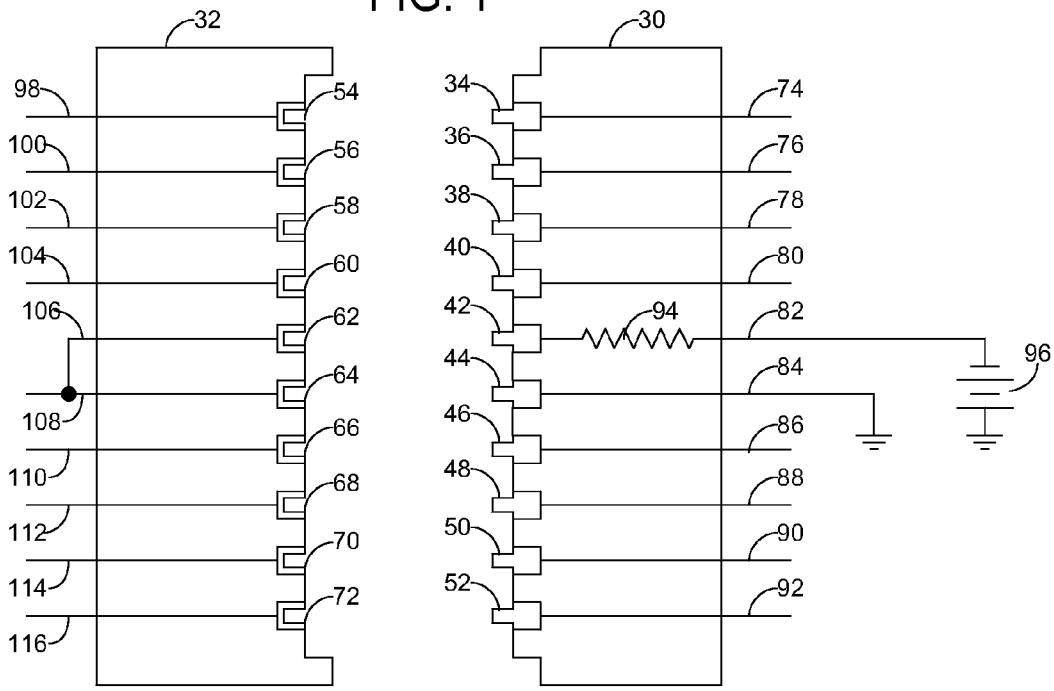
FIG. 1 is a schematic depiction of a pair of mating connectors one of which includes a heating resistor therein which resistors, when the mating connectors are mechanically mated together and the device is electrically connected to a power source, will heat the mating connectors.

Referring first to FIG. 1, a first embodiment of the present invention is illustrated which includes a first electrical connector 30 and a second electrical connector 32 are shown in schematic form. For purposes of discussion, it will be assumed herein that the first electrical connector 30 will be electrically connected to a vehicle (not shown herein) and that the second electrical connector 32 will be electrically connected to a snow plow (also not shown herein). Each of the first electrical connector 30 and the second electrical connector 32 is a ten-pin electrical connector, with the first electrical connector 30 being shown as a male connector and the second electrical connector 32 being shown as a female connector (although they could certainly be reversed if desired).

The first electrical connector 30 has ten male contacts 34, 36, 38, 40, 42, 44, 46, 48, 50, and located therein. The second electrical connector 32 has ten female contacts 54, 56, 58, 60, 62, 64, 66, 68, 70, and 72 that will respectively mater with the ten male contacts 34, 36, 38, 40, 42, 44, 46, 48, 50, and 52 in the first electrical connector 30 when the first electrical connector 30 and the second electrical connector 32 are mated together. As shown in FIG. 1, the first electrical connector 30 and the second electrical connector 32 each have ten contacts, although it will be appreciated by those skilled in the art that they could each have more or fewer contacts, and that they may be any of a wide variety of different types of mating electrical connectors, with the specific application generally dictating the type of electrical connectors to be utilized.

It may be seen that there are ten wires 74, 76, 78, 80, 82, 84, 86, 88, 90, and 92 extending from the first electrical connector 30. The wires 74, 76, 78, 80, 84, 86, 88, 90, and 92 are respectively electrically connected to male contacts 34, 36, 38, 40, 44, 46, 48, 50, and 52. The male contact 42 is electrically connected to one side of a resistor 94, the other side of which is electrically connected to one end of the wire 82.

The other end of the wire 82 is electrically connected to one side of a power source 96, which may be, for example a battery (in a vehicular application, the battery of the vehicle), the other side of which power source 96 is electrically connected to ground (in a vehicular application, the battery of the vehicle). The wire 84 is also electrically connected to ground. (Alternatively, the side of the power source 96 shown as being electrically connected to ground could instead be electrically connected to the wire 84.)

There are also ten wires 98, 100, 102, 104, 106, 108, 110, 112, 114, and 116 extending from the second electrical connector 32. The wires 98, 100, 102, 104, 106, 108, 110, 112, 114, and 116 are respectively electrically connected to the female contacts 54, 56, 58, 60, 62, 64, 66, 68, 70, and 72. The wire 106 is electrically connected to the wire 108, thereby electrically connecting the female terminals 62 and 64.

When the first electrical connector 30 and the second electrical connector 32 shown in FIG. 1 are matingly connected together, the ten male contacts 34, 36, 38, 40, 42, 44, 46, 48, 50, and 52 in the first electrical connector 30 will be respectively electrically connected to the ten female contacts 54, 56, 58, 60, 62, 64, 66, 68, 70, and 72 in the second electrical connector 32. This will accordingly electrically connect the wires 74, 76, 78, 80, 84, 86, 88, 90, and 92 extending from the first electrical connector 30 to wires 98, 100, 102, 104, 108, 110, 112, 114, and 116 extending from the second electrical connector 32.

It will also complete the circuit including the power source 96 and the resistor 94, with that circuit beginning at one side of the power source 96 and including the wire 82, the resistor 94, the male contact 42, the female contact 62, the wire 106, the wire 108, the female contact 64, the male contact 44, and the wire 84, and ending at the other side of the power source 96. This will energize the resistor 94, causing power to be dissipated in the resistor 94, thereby heating it and the first electrical connector 30, as well as heating the second electrical connector somewhat by virtue of its proximity to the first electrical connector 30.

It will also be appreciated by those skilled in the art that instead of providing the return current path through the wire 108, the female contact 64, the male contact 44, and the wire 84, the wire 106 could instead be grounded and thereby connected to the other side of the power source 96.

Figure 2:
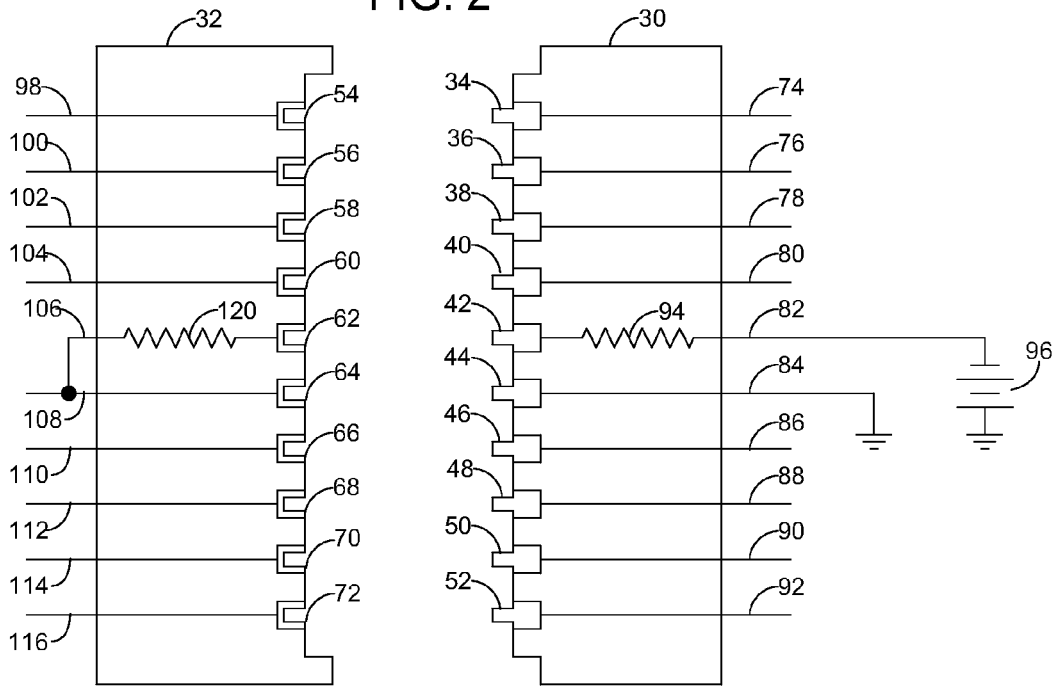
FIG. 2 is a schematic depiction of a pair of mating connectors each of which includes a heating resistor therein which, when the mating connectors are mechanically mated together and the device is electrically connected to a power source, will heat the mating connectors.

Turning next to FIG. 2, a second embodiment of the heated electrical connector of the present invention is illustrated. In FIG. 2, as well as in FIGS. 3 through 6, elements that are similar to components illustrated in FIG. 1 shall be referred to using identical reference numerals. The embodiment of FIG. 2 is identical to the embodiment of FIG. 1, with a single difference. Instead of the wire 106 being electrically connected directly to the female contact 62, it is instead electrically connected to one side of a resistor 120, the other side of which is electrically connected to the female contact 62.

When the first electrical connector 30 and the second electrical connector 32 shown in FIG. 2 are matingly connected together, the circuit including the power source 96, the resistor 94, and the resistor 120 will be connected together. This circuit begins at one side of the power source 96 and includes the wire 82, the resistor 94, the male contact 42, the female contact 62, the resistor 120, the wire 106, the wire 108, the female contact 64, the male contact 44, and the wire 84, and ending at the other side of the power source 96. This will energize both the resistor 94 and the resistor 120, causing power to be dissipated in both of the resistors 94 and 120, thereby heating them and both the first electrical connector 30 and the second electrical connector 32.

For the embodiments of FIGS. 1 and 2, the value of the resistor 94 (FIG. 1) or the values of the resistors 94 and 120 (FIG. 2) will determine the power that will be dissipated as heat inside the first and second electrical connector 30 and 32. Since the power source 96 is approximately 14.7 Volts in a vehicle, various resistances can be calculated as a function of the power to be dissipated in the resistor 94 (FIG. 1) or the combined resistance of the resistors 94 and 120 (FIG. 2) using the formula $P=V^2M$. For example, 0.25 Watt requires 864 Ohms, 0.5 Watt requires 432 Ohms, 1.0 Watt requires 216 Ohms, 1.5 Watts requires 144 Ohms, 2.0 Watts requires 108 Ohms, 2.5 Watts requires 86 Ohms, and 3.0 Watts requires 72 Ohms, and 3.6 Watts requires 60 Ohms. As those skilled in the art will realize, the resistors 94 and 120 will likely need to be power resistors in order to avoid degradation caused by heating. The exact power required will of course depend upon both the design of the first and second electrical connectors 30 and 32, as well as the lowest ambient temperature that the first and second electrical connectors 30 and 32 are to be used in.

Figure 3:
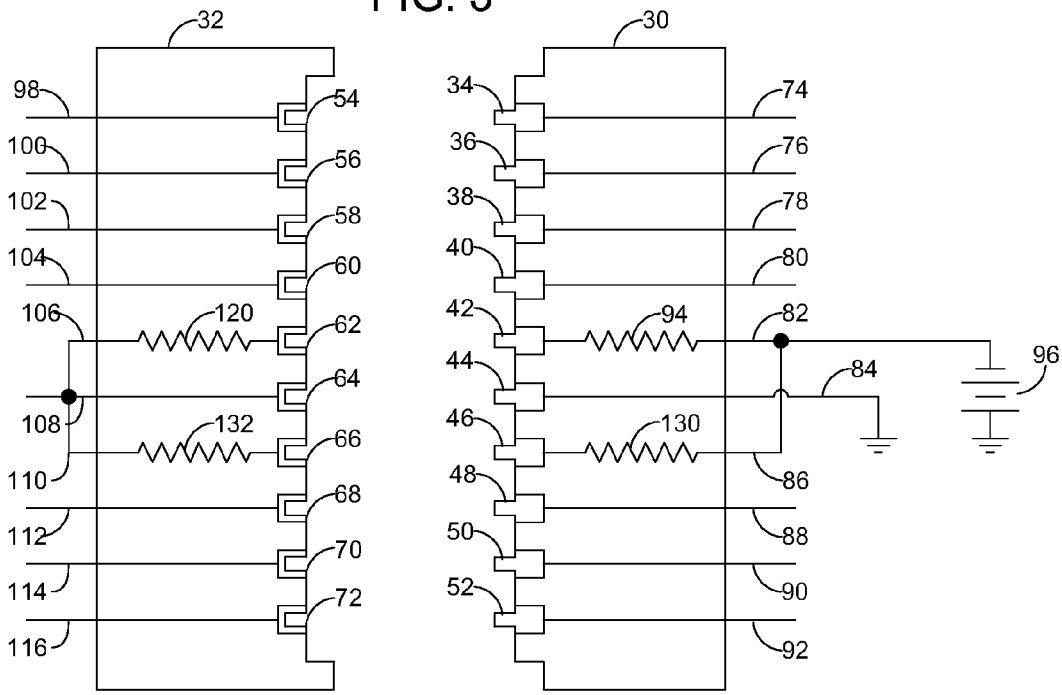
FIG. 3 is a schematic depiction of a pair of mating connectors each of which includes a plurality of heating resistors therein each of which is connected to a different pin which resistors, when the mating connectors are mechanically mated together and the device is electrically connected to a power source, will heat the mating connectors.

Turning now to FIG. 3, a third embodiment of the heated electrical connector of the present invention is illustrated. The embodiment of FIG. 3 is identical to the embodiment of FIG. 2, with several differences. Instead of the wire 86 being electrically connected directly to the male contact 46, it is instead electrically connected between one side of a resistor 130 and the wire 82, with the other side of the resistor 130 being electrically connected to the male contact 46. Instead of the wire 110 being electrically connected directly to the female contact 66, it is instead electrically connected between one side of a resistor 132 and the wire 108, with the other side of the resistor 132 being electrically connected to the female contact 66.

When the first electrical connector 30 and the second electrical connector 32 shown in FIG. 3 are matingly connected together, the resistor 94 and the resistor 120 are electrically connected in series, and the resistor 130 and the resistor 132 are also electrically connected in series. The series connected resistors 94 and 120 are electrically connected in parallel with the resistors 130 and 132. The circuit including the power source 96, the resistor 94, the resistor 120, the resistor 130, and the resistor 132 will be connected together.

This circuit has two parallel paths: the first begins at one side of the power source 96 and includes the wire 82, the resistor 94, the male contact 42, the female contact 62, the resistor 120, the wire 106, the wire 108, the female contact 64, the male contact 44, and the wire 84, and ends at the other side of the power source 96; the second begins at one side of the power source 96 and includes the wire 82, the wire 86, the resistor 130, the male contact 46, the female contact 66, the resistor 132, the wire 110, the wire 108, the female contact 64, the male contact 44, and the wire 84, and ends at the other side of the power source 96. This energizes the resistor 94, the resistor 120, the resistor 130, and the resistor 132, causing power to be dissipated in all four of the resistors 94, 120, 130, and 132, thereby heating them and both the first electrical connector 30 and the second electrical connector 32.

As an alternative to the embodiment shown in FIG. 3, the resistors 120 and 130 could be deleted (with the wire 106 being electrically connected directly to the female contact 62 and the wire 86 being electrically connected directly to the male contact 46), leaving the resistors 94 and 132 effectively connected in parallel, with each getting the full voltage of the power source 96.

Figure 4:
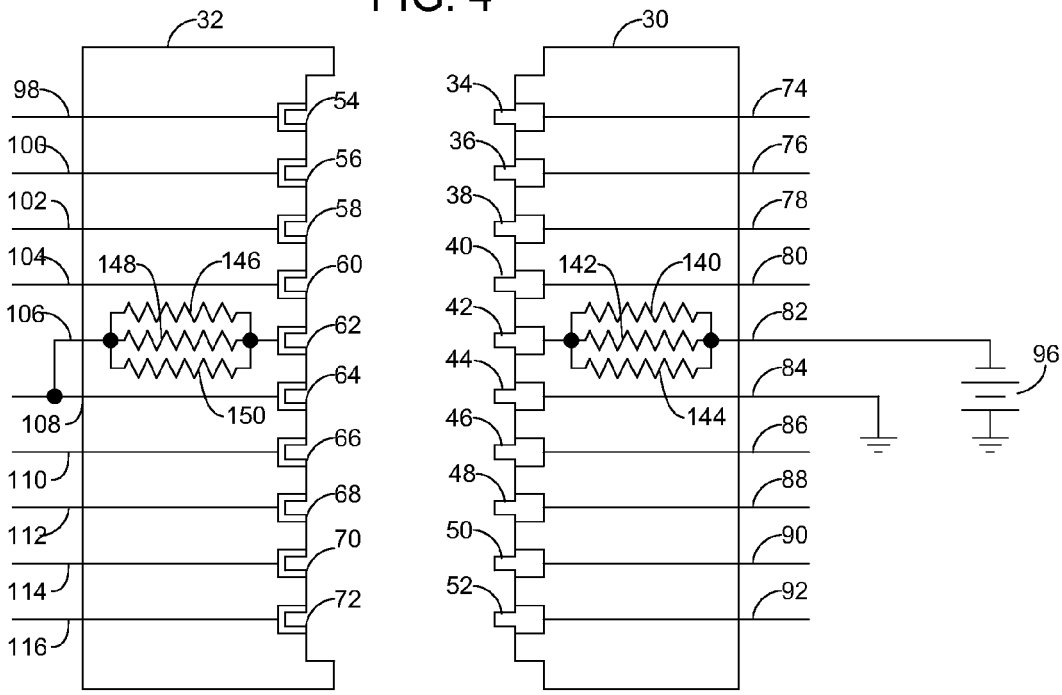
FIG. 4 is a schematic depiction of a pair of mating connectors each of which includes a plurality of parallel connected heating resistors therein which, when the mating connectors are mechanically mated together and the device is electrically connected to a power source, will heat the mating connectors.

Turning now to FIG. 4, a fourth embodiment of the heated electrical connector of the present invention is illustrated. The embodiment of FIG. 4 is identical to the embodiment of FIG. 2, with several differences. Instead of using the resistor 94 electrically connected between the male contact 42 and the wire 82, three resistors 140, 142, and 144 are instead electrically connected in parallel between the male contact 42 and the wire 82. Instead of using the resistor 120 electrically connected between the female contact 62 and the wire 106, three resistors 146, 148, and 150 are instead electrically connected in parallel between the female contact 62 and the wire 106. The six resistors 140, 142, 144, 146, 148, and 150 have a greater heating capacity than the two resistors the resistor 94 and the resistor 120 used in FIG. 2.

When the first electrical connector 30 and the second electrical connector 32 shown in FIG. 4 are matingly connected together, the circuit including the power source 96, the three parallel resistors 140, 142, and 144, and the three parallel resistors 146, 148, and 150 will be connected together. This circuit begins at one side of the power source 96 and includes the wire 82, the three parallel resistors 140, 142, 144, the male contact 42, the female contact 62, the three parallel resistors 146, 148, and 150, the wire 106, the wire 108, the female contact 64, the male contact 44, and the wire 84, and ending at the other side of the power source 96. This will energize three parallel resistors 140, 142, and 144 which are in series with the three parallel resistors 146, 148, and 150, causing power to be dissipated in all of the resistors 140, 142, 144, 146, 148, and 150, thereby heating them and both the first electrical connector 30 and the second electrical connector 32.

Figure 5:
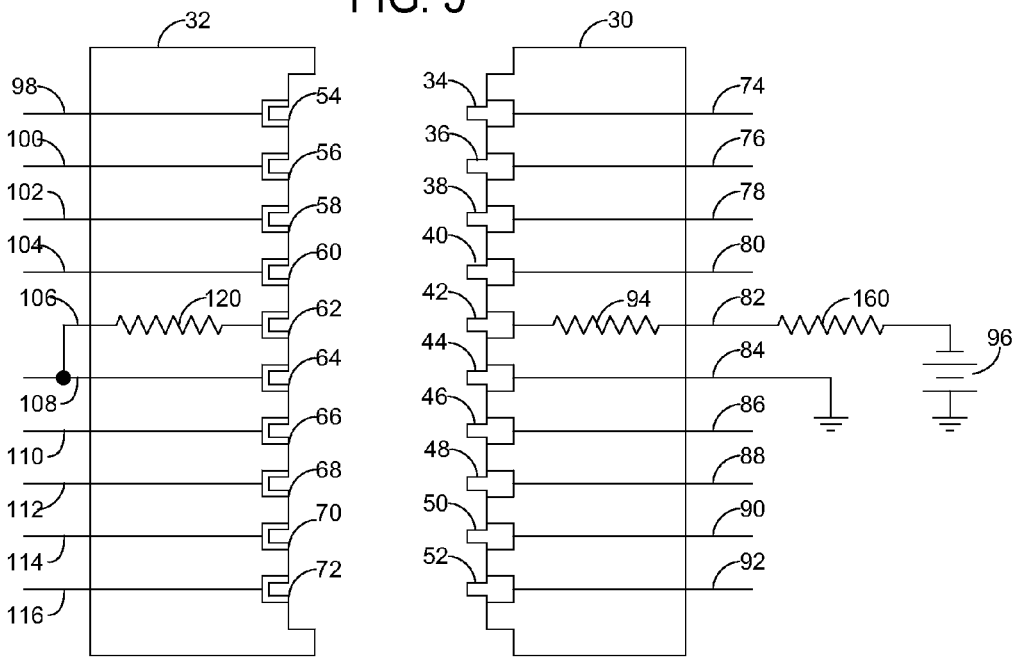
FIG. 5 is a schematic depiction of a pair of mating connectors each of which includes a heating resistor therein which, when the mating connectors are mechanically mated together and the device is electrically connected to a power source in a circuit including an externally located resistor, will heat the mating connectors.

Turning now to FIG. 5, a fifth embodiment of the heated electrical connector of the present invention is illustrated. The embodiment of FIG. 5 is identical to the embodiment of FIG. 2, with one difference. Instead of having the wire 82 electrically connected between the resistor 94 and the one side of the power source 96, the wire 82 is electrically connected between the resistor 94 and one end of a resistor 160, the other end of which is electrically connected to the one side of the power source 96. By appropriately selecting the resistance of the resistor 160 with respect to the resistances of the resistors 94 and 120, the proportion of the power that will be dissipated in the resistors 94 and 120 can be established.

When the first electrical connector 30 and the second electrical connector 32 shown in FIG. 5 are matingly connected together, the circuit including the power source 96, the resistor 160, the resistor 94, and the resistor 120 will be connected together. This circuit begins at one side of the power source 96 and includes the resistor 160, the wire 82, the resistor 94, the male contact 42, the female contact 62, the resistor 120, the wire 106, the wire 108, the female contact 64, the male contact 44, and the wire 84, and ending at the other side of the power source 96. This will energize both the resistor 160 and the resistors 94 and 120, causing the selected proportion of power to be dissipated in each of the resistors 94 and 120, thereby heating them and both the first electrical connector 30 and the second electrical connector 32. This design allows a voltage lower than that of the power source 96 to be placed across the resistors 94 and the resistor 120.

Figure 6:
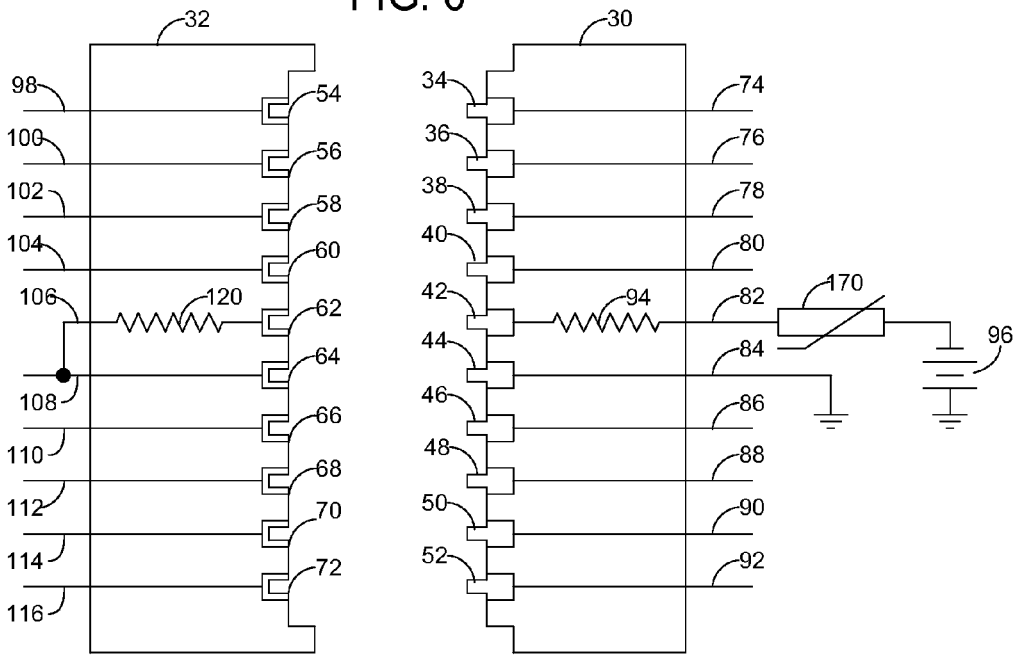
FIG. 6 is a schematic depiction of a pair of mating connectors each of which includes a heating resistor therein which, when the mating connectors are mechanically mated together and the device is electrically connected to a power source in a circuit including an externally located PTC thermistor, will heat the mating connectors.

Turning now to FIG. 6, a sixth embodiment of the heated electrical connector of the present invention is illustrated. The embodiment of FIG. 6 is identical to the embodiment of FIG. 5, with one difference. Instead of having the resistor 160 electrically connected between the one side of the power source 96 and the wire 82, a thermistor 170 is electrically connected between the one side of the power source 96 and the wire 82. The thermistor 170 is a positive temperature coefficient (PTC) thermistor in which the resistance increases with increasing temperature. As the ambient temperature decreases, it is necessary to dissipate more power in the resistors and 120 in order to heat the first and second electrical connectors 30 and 32, respectively, in order to prevent snow or ice from building up on the outside of the first and second electrical connectors 30 and 32. By appropriately selecting the thermistor 170 and the resistances of the resistors 94 and 120, the proportion of the power that will be dissipated in the resistors 94 and 120 will increase as the ambient temperature on the thermistor 170 decreases.

Figure 7:
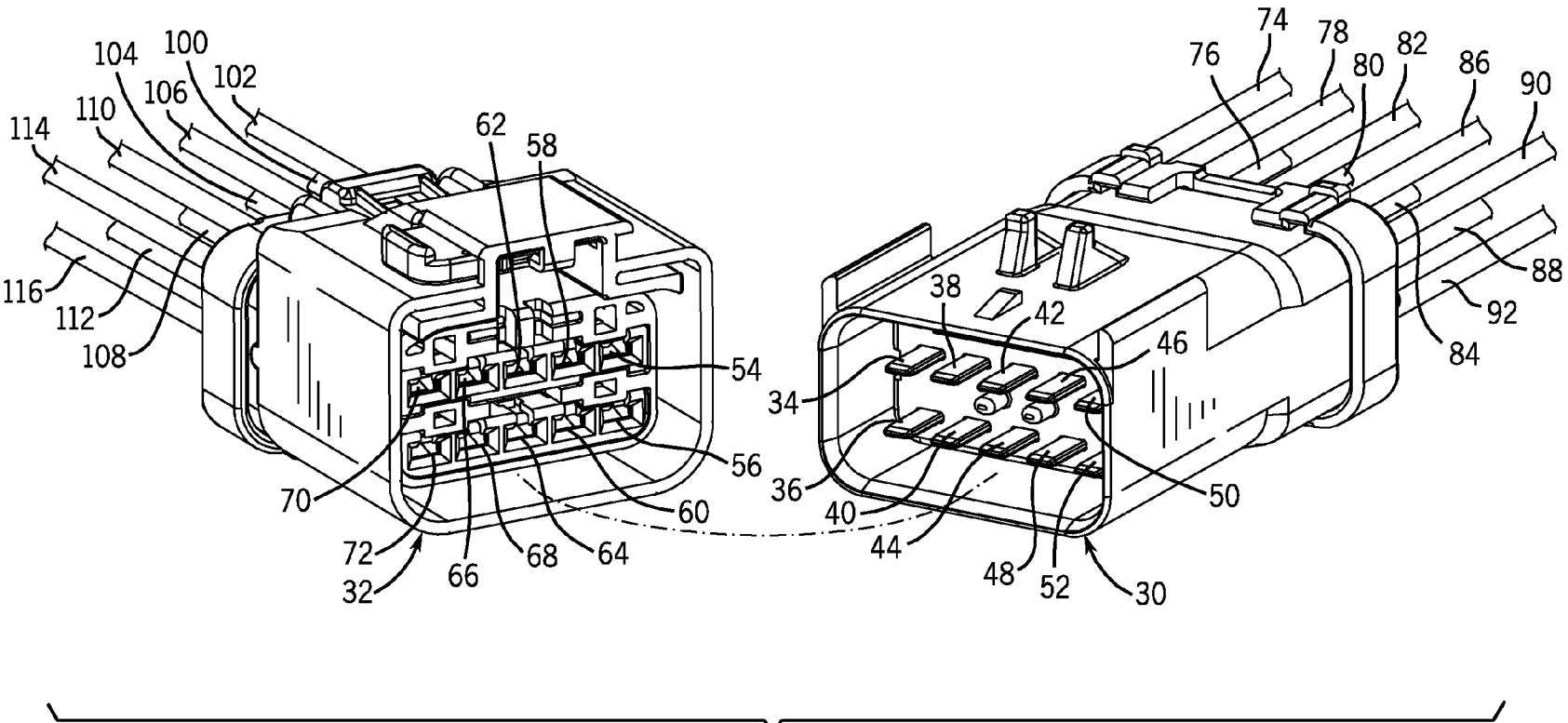
FIG. 7 is an isometric drawing showing an exemplary pair of mating connectors.
Figure 8:
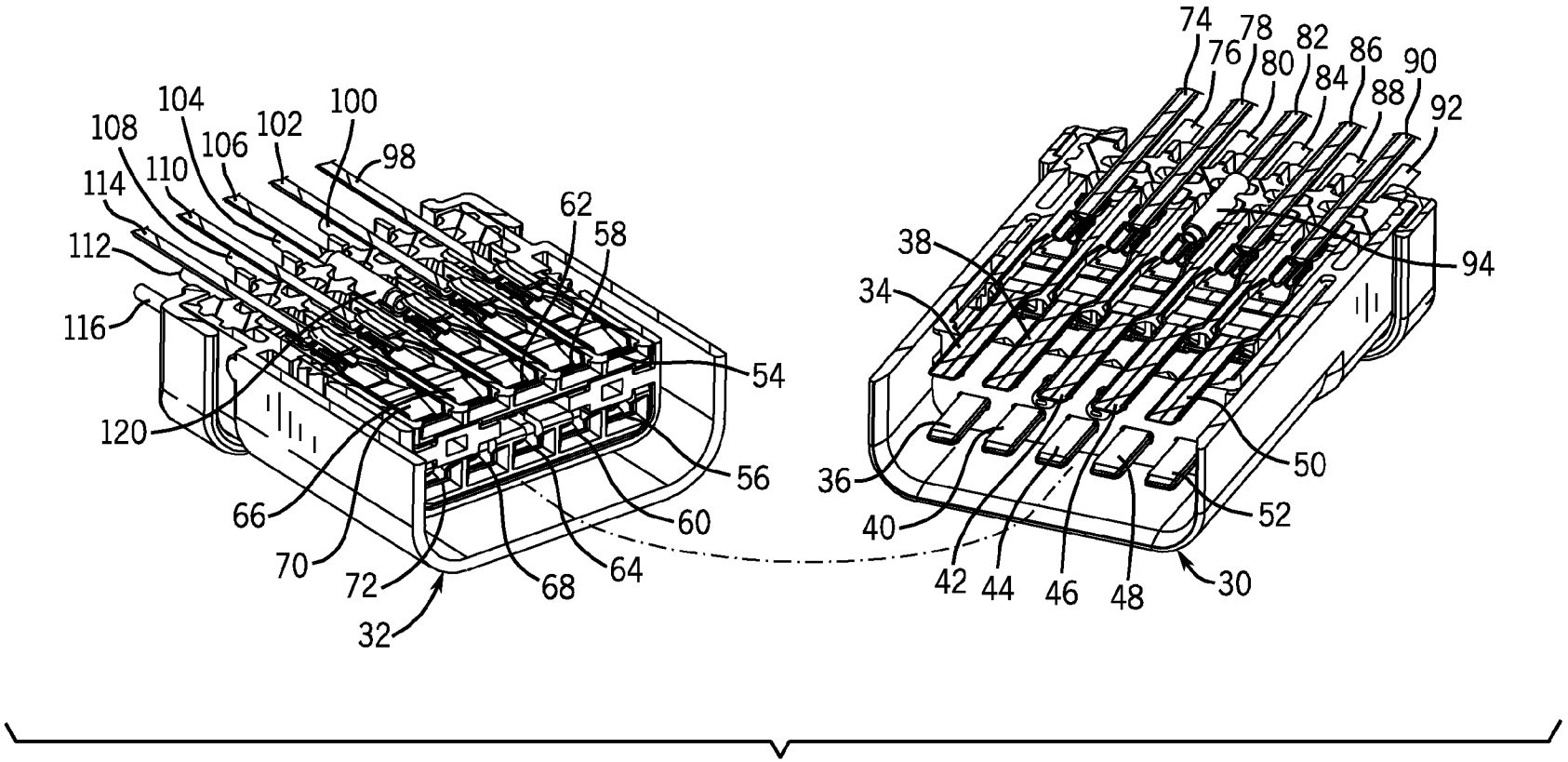
FIG. 8 is a cutaway isometric drawing showing the resistors located inside each of the mating connectors shown in FIG. 7.

Finally, with reference to FIGS. 7 and 8, an exemplary mating pair of first and second electrical connectors 30 and 32 is illustrated which may be, for example, a 10-pin set of mating male and female connectors that are commercially available from FCI in Westland, Mich., and which are as shown, for example, in U.S. Pat. No. 7,303,447, which is hereby incorporated herein by reference. The first and second electrical connectors 30 and 32 are cut away in FIG. 8 to show the resistor 94 in the first electrical connector 30 and the resistor 120 in the second electrical connector 32. The first and second electrical connectors 30 and 32 may each have housings with integrated sealing elements to sealingly engage each other with a seal being formed therebetween to protect the contacts contained therein from exposure to the ambient environment. The first and second electrical connectors 30 and 32 may also have a locking mechanism such as an integral releasable locking latch to prevent them from coming apart when the locking mechanism is engaged. It will be appreciated by those skilled in the art that the principles of the heated electrical connector of the present invention could be applied to any of a wide number of different types and configurations of connectors without departing from the spirit of the present invention.

It may therefore be appreciated from the above detailed description of the preferred embodiment of the present invention that it improves the characteristics electrical connectors exhibit in cold ambient weather conditions by heating the electrical connectors. Such heated electrical connectors exhibit the capability of inhibiting the buildup of snow and ice on the exterior surface of the electrical connectors. Further, such heated electrical connectors are substantially easier to disconnect from each other even in very cold ambient weather conditions.

The heated electrical connector of the present invention is of a construction which is both durable and long lasting, and which will require little or no maintenance to be provided by the user throughout its operating lifetime. The heated electrical connector of the present invention is also of inexpensive construction to enhance its market appeal and to thereby afford it the broadest possible market. Finally, all of the aforesaid advantages and objectives of the heated electrical connector of the present invention are achieved without incurring any substantial relative disadvantage.

Although the foregoing description of the heated electrical connector of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A heated connector assembly, comprising:

a first electrical connector having a first plurality of electrical contacts contained therein which may be respectively electrically connected to a first plurality of electrical conductors extending from said first electrical connector;

a second electrical connector having a second plurality of electrical contacts contained therein which may be respectively electrically connected to a second plurality of electrical conductors extending from said second electrical connector, wherein said first electrical connector and said second electrical connector may be removably connected to each other to place said first plurality of electrical contacts in said first electrical connector into electrical contact with respective ones of said second plurality of electrical contacts in said second electrical connector; and a first electrical heat generating element located in said first electrical connector, said first electrical heat generating element being electrically connected in series between a first one of said first plurality of electrical contacts in said first electrical connector and a first one of said first plurality of electrical conductor extending from said first electrical connector, wherein the heat generating element is energized through both connectors and only when the first and second electrical connector are coupled together.

2. A heated connector assembly as defined in claim 1, wherein said first electrical connector is of a first gender and said second electrical connector is of a second gender that is different from said first gender.

3. A heated connector assembly as defined in claim 2, wherein said first electrical connector is a male connector and said second electrical connector is a female connector.

4. A heated connector assembly as defined in claim 1, wherein said first electrical connector and said second electrical connector each have housings such that whenever said first electrical connector is connected to said second electrical connector the ambient environment is sealed out of the housings.

5. A heated connector assembly as defined in claim 1, wherein said first electrical connector and said second electrical connector each have housings with integral engageable and releasable locking latch elements such that when said first and second electrical connectors are connected together they remain connected together until said locking latch is released.

6. A heated connector assembly as defined in claim 1, wherein both first electrical connector and said second electrical connector are ten-pin connectors.

7. A heated connector assembly as defined in claim 1, wherein said first one of said first plurality of electrical contacts in said first electrical connector is electrically connected with a first one of said second plurality of electrical contacts in said second electrical connector when said first and said second electrical connectors are connected to each other; and wherein said first one of said second plurality of electrical contacts in said second electrical connector is electrically connected to a first one of said second electrical conductors extending from said second electrical connector.

8. A heated connector assembly as defined in claim 7, wherein said first electrical heat generating element in said first electrical connector is configured to generate heat when an electrical power source is connected between said first one of said first electrical conductors extending from said first electrical connector and said first one of said second electrical conductors extending from said second electrical connector.

9. A heated connector assembly as defined in claim 1, wherein a second one of said second plurality of electrical contacts in said second electrical connector is electrically connected to a second one of said second plurality of electrical conductors extending from said second electrical connector; and a second one of said first plurality of electrical contacts in said first electrical connector is electrically connected to a second one of said first plurality of electrical conductor extending from said first electrical connector; and wherein said first and second ones of said second plurality of electrical conductors extending from said second electrical connector are electrically connected together; and wherein said second one of said first plurality of electrical contacts in said first electrical connector is electrically connected with said second one of said second plurality of electrical contacts in said second electrical connector when said first and said second electrical connectors are connected to each other.

10. A heated connector assembly as defined in claim 9, wherein said first electrical heat generating element in said first electrical connector is configured to generate heat when an electrical power source is connected between said first and second electrical conductors extending from said first electrical connector.

11. A heated connector assembly as defined in claim 1, wherein said first electrical heat generating element comprises:

a resistor.

12. A heated connector assembly as defined in claim 1, additionally comprising:

an external resistor located externally of both of said first and second electrical connectors;

wherein said external resistor is configured to be electrically connected in series with a power source and a circuit comprising said first one of said first electrical conductors extending from said first electrical connector and said first one of said second electrical conductors extending from said second electrical connector, whereby said external resistor will reduce the amount of electrical power from said power source that is dissipated in said first electrical heat generating element.

13. A heated connector assembly as defined in claim 1, additionally comprising:

a thermistor located externally of both of said first and second electrical connectors;

wherein said thermistor is configured to be electrically connected in series with a power source and a circuit comprising said first one of said first electrical conductors extending from said first electrical connector and said first one of said second electrical conductors extending from said second electrical connector, whereby said thermistor will reduce the amount of electrical power from said power source that is dissipated in said first electrical heat generating element.

14. A heated connector assembly as defined in claim 13, wherein said thermistor is a positive temperature coefficient (PTC) thermistor in which the resistance increases with increasing temperature to cause the proportion of electrical power from said power source that will be dissipated in said first electrical heat generating element to increase as the ambient temperature decreases.

15. A heated connector assembly as defined in claim 1, additionally comprising:

a second electrical heat generating element located in said first electrical connector, said second electrical heat generating element being electrically connected in parallel with said first electrical heat generating element between said first one of said first plurality of electrical contacts in said first electrical connector and said first one of said first plurality of electrical conductor extending from said first electrical connector.

16. A heated connector assembly as defined in claim 1, additionally comprising:

a second electrical heat generating element located in said first electrical connector, said second electrical heat generating element being electrically connected between a second one of said first plurality of electrical contacts in said first electrical connector and a second one of said first plurality of electrical conductor extending from said first electrical connector;

wherein said first and second ones of said first plurality of electrical contacts in said first electrical connector are respectively electrically connected with first and second ones of said second plurality of electrical contacts in said second electrical connector when said first and said second electrical connectors are connected to each other; and wherein said first and second ones of said second plurality of electrical contacts in said second electrical connector are respectively electrically connected to first and second ones of said second electrical conductors extending from said second electrical connector.

17. A heated connector assembly as defined in claim 1, wherein said first electrical heat generating element is capable of dissipating between 0.25 Watts and 3.6 Watts.

18. A heated connector assembly as defined in claim 1, additionally comprising:

a second electrical heat generating element located in said second electrical connector, said second electrical heat generating element being electrically connected between a first one of said second plurality of electrical contacts in said second electrical connector and a first one of said second plurality of electrical conductors extending from said second electrical connector;

wherein said first one of said first plurality of electrical contacts in said first electrical connector is electrically connected with said first one of said second plurality of electrical contacts in said second electrical connector when said first and said second electrical connectors are connected to each other.

19. A heated connector assembly as defined in claim 18, wherein said first electrical heat generating element in said first electrical connector and said second electrical heat generating element in said second electrical connector are configured to generate heat when an electrical power source is connected between said first electrical conductor extending from said first electrical connector and said first electrical conductor extending from said second electrical connector.

20. A heated connector assembly as defined in claim 18, wherein said first and second electrical heat generating elements each comprises:

a resistor.

21. A heated connector assembly as defined in claim 18, wherein said first and second electrical heat generating elements are capable of dissipating between 0.25 Watts and 3.6 Watts.

22. A heated connector assembly, comprising:

a first electrical connector having a first plurality of electrical contacts contained therein which may be respectively electrically connected to a first plurality of electrical conductors extending from said first electrical connector;

a second electrical connector having a second plurality of electrical contacts contained therein which may be respectively electrically connected to a second plurality of electrical conductors extending from said second electrical connector;

a first electrical heat generating element located in said first electrical connector, said first electrical heat generating element being electrically connected between one of said first plurality of electrical contacts in said first electrical connector in series and a first one of said first plurality of electrical conductor extending from said first electrical connector;

a second electrical heat generating element located in said second electrical connector, said second electrical heat generating element being electrically connected between one of said second plurality of electrical contacts in said second electrical connector and a first one of said second plurality of electrical conductors extending from said second electrical connector;

wherein said first electrical connector and said second electrical connector may be removably connected to each other to place said first and second electrical heat generating elements into a series connection with each other;

wherein said first and second electrical heat generating elements are configured to generate heat when an electrical power source is connected between said first electrical conductor extending from said first electrical connector and said first electrical conductor extending from said second electrical connector.

23. A method of heating a connector assembly, comprising:

electrically connecting a first plurality of electrical contacts contained in a first electrical connector to a first plurality of electrical conductors extending from said first electrical connector;

electrically connecting a second plurality of electrical contacts contained in a second electrical connector to a second plurality of electrical conductors extending from said second electrical connector, wherein said first electrical connector and said second electrical connector may be removably connected to each other to place said first plurality of electrical contacts in said first electrical connector into electrical contact with respective ones of said second plurality of electrical contacts in said second electrical connector; and electrically connecting a first electrical heat generating element located, in series, in said first electrical connector to a first one of said first plurality of electrical contacts in said first electrical connector and a first electrical conductor extending from said first electrical connector, wherein the heat generating element is energized through both connectors and only when the first and second connector are coupled together.

* * * * *

UNITED STATES PATENT AND TRADEMARK OFFICE

CERTIFICATE OF CORRECTION

PATENT NO. : 7,959,463 B1
APPLICATION NO. : 12/781345
DATED : June 14, 2011
INVENTOR(S) : William F. Menze et al.

It is certified that error appears in the above-identified patent and that said Letters Patent is hereby corrected as shown below:

Column 1, Line 36:
"power connection multiple electrical" should read --power connection and multiple electrical--.

Column 4, Line 50:
"50, and located herein" should read --50, and 52 located herein--.

Column 5, Line 40:
"connector somewhat" should read --connector 32 somewhat--.

Column 6, Line 11:
"$P=V^2M$" should read --$P=V^2/R$--.

Column 7, Line 19:
"142, 144" should read --142, and 144--.

Column 8, Line 2:
"resistors and 120" should read --resistors 94 and 120--.

Signed and Sealed this
Twenty-ninth Day of November, 2011

David J. Kappos

David J. Kappos
*Director of the United States Patent and Trademark Office*